United States Patent [19]

Becker et al.

[11] Patent Number: 4,463,674

[45] Date of Patent: Aug. 7, 1984

[54] MOUNTING MEANS FOR A WATER UNIT TO A PRINTING PRESS

[76] Inventors: Michael T. Becker, 306 Caulder St.; William D. O'Brien, 4808 Fairview Dr., both of Des Moines, Iowa 50309

[21] Appl. No.: 384,104

[22] Filed: Jun. 1, 1982

[51] Int. Cl.[3] ..... B41F 7/26; B41F 7/32; B41F 7/40; B41L 25/02

[52] U.S. Cl. ..... 101/148; 101/352

[58] Field of Search ..... 101/148, 349, 350, 351, 101/352, 207–210

[56] References Cited

U.S. PATENT DOCUMENTS

| | | | |
|---|---|---|---|
| 2,708,874 | 5/1955 | Schultz | 101/148 |
| 2,929,316 | 3/1960 | Fowlie | 101/148 |
| 3,286,622 | 11/1966 | Mestre | 101/218 |
| 3,404,625 | 10/1968 | White | 101/148 |
| 3,431,842 | 3/1969 | Winkler et al. | 101/148 |

FOREIGN PATENT DOCUMENTS

| | | | |
|---|---|---|---|
| 1601603 | 11/1981 | United Kingdom | 101/349 |

*Primary Examiner*—J. Reed Fisher

*Attorney, Agent, or Firm*—Zarley, McKee, Thomte, Voorhees & Sease

[57] ABSTRACT

The mounting hardware for the attachment of a water unit to a printing press includes two mounting members attached on opposite sides of the revolving plate cylinder of the printing press. The water unit is mounted on the top surfaces of the front ends of the mounting members and is positioned over the plate cylinder. The top surfaces of the back ends of the mounting members are raised in comparison to the front ends and can support a transparent shield which extends rearwardly of the back ends. A rod interconnects the two mounting members at their back ends and serves to hingeably support the water unit. Two inking unit brackets attach to opposite sides of the printing press slightly back of and below the back ends of the mounting members and extend rearwardly in an inverted L-shape to support the inking unit of the printing press.

17 Claims, 4 Drawing Figures

MOUNTING MEANS FOR A WATER UNIT TO A PRINTING PRESS

BACKGROUND OF THE INVENTION

1. Field of Invention

This invention relates to hardware for the mounting of a water unit to a printing press, more particularly, mounting hardware for the mounting of a Varn Kompac © automatic dampening system to a Chief 15 or 17 printing press manufactured by American Type Founders (ATF).

2. Description of Prior Art

Maintenance of the proper ink-water balance presents the most difficult task to operators of offset printing presses. This problem accounts for most of the stock and ink waste, down-time, and the general loss of quality that drains profits.

Standard small offset printing presses generally operate as follows: A paper (called stock) feeding mechanism delivers the blank stock to an assembly of rollers, one of which has the plate holding the image which is to be transferred to the stock.

The offset process requires three cylinders for production. The plate cylinder has a relatively thin zinc or aluminum prepared printing plate fastened tightly around its circumference. Super-imposed around this plate cylinder are the inking and watering, mechanisms. The plate cylinder does not come in contact with the paper or other material to be printed; instead, the plate cylinder impresses an image on an intermediate cylinder around which is affixed a specially composed smooth rubber blanket. The rubber blanket, having received the impression, in turn transfers or offsets it onto the paper or other material while it is being carried around the actual impression cylinder, rotating in juxtaposition to the first two cylinders.

In lithographic offset printing, the image on the plate retains ink as it passes by the inking unit, but is insoluble to water as it passes by the water unit. The non-image areas of the plate are not so treated and are wiped clean with water from the water unit. These wiped off areas then become the blank areas of the stock.

Conventional water units for small offset printing presses have a number of rollers, some with absorbent covers called "molletons" which serve to take water and apply it to the plate. Severe problems exist with conventional water units, however, in that the maintenance of the proper ink-water balance is extremely difficult.

Not only must this balance be monitored closely and constantly adjusted by the operator, but also, the very nature of the equipment produces water drips upon stock and often creates dirty copies. The operator must continually wash the plate to keep it as clean as possible and avoid imperfections upon the copies. The operator must also periodically change the molletons as they wear out.

Additionally, conventional water units require a substantial start-up period of approximately 8–15 minutes. The resulting waste in paper from start-up times, dirty copies, and throw aways is substantial. The time involved in start-ups, changing of molletons, and adjustment of the water unit also is substantial.

To combat the ink-water balance problem, Varn Products Company, Incorporated of Oakland, NJ developed an automatic dampening system called Kompac ©. The Kompac unit utilizes just two rollers; a larger plate form roller, next to a smaller metering roller. The Kompac unit forms a reservoir of special fountain solution in the space called the "nip" between the two rollers. The inward rotating action within the nip mills the solution into the ink, producing extremely fine droplets which are transferred by the plate form roller to the plate. With a squeegee-like action, the plate form roller "splits" the emulsion into components which appropriately coat the image and non-image areas of the plate. A primary feature of the Kompac unit is that any surplus solution is returned to the nip reservoir as the gap between ends of the plate on the plate cylinder passes under the plate form roller.

Both the plate form water roller and metering roller carry ink as picked up from the plate cylinder. This helps ink coverage of the printing press while using less water and ink by allowing the application of a thinner coat of both.

The Kompac unit requires negligible start-up time, allowing the pressman to hang the plate, put the fountain solution into the system, and deliver a sharp clean copy within 45 seconds so that the second or third sheet may be of selling quality. The solution film is automatically adjusted by the image size, requiring the operator to adjust only the ink keys. This thinner film of ink produces less lint hickeys, permits faster drying for quicker turn-around, and higher press speeds without jamming. Significant improvement in quality, productivity and efficiency result without costly waste of time, replacement of molletons and waste of stock.

The Kompac unit is available for use with multiliths such as models 1250 and 1250 LW, and A. B. Dick printing presses Models 350 and 360. However, the Kompac unit cannot be mounted upon presses such as American Type Founders Models Chief 15 and 17, which particularly have problems associated with their standard equipment water units. There is a real and pressing need for the use of the Kompac unit with presses such as the Chief 15 and 17.

It is therefore an object of this invention to provide a mounting means for operably mounting the Kompac automatic dampening system upon American Type Founders Chief 15 and 17 offset printing presses.

It is a further object of this invention to provide a mounting means for water units upon small offset printing presses.

Another object of this invention is to provide a mounting means for water units which is sturdy, economical and easily adapted.

Additional objects, features, and advantages of the invention will become apparent with reference to the accompanying specification and drawings.

SUMMARY OF THE INVENTION

This invention utilizes left and right mounting members which are attached to a printing press on opposite sides of the plate cylinder. The front ends of the members allow the mounting of a water unit for the maintenance of ink-water balance on the plate. The water unit extends across the full longitudinal length of the plate and plate cylinder, and comes into contact with the plate.

The back ends of the mounting members are vertically thicker than the front ends and can receive a transparent shield on their top surfaces. The shield serves to prevent the operator's hands from becoming entangled in the printing press machinery in back of the water unit.

A rod extends between the two mounting members and is removably positioned in horizontal apertures in the side walls of the back ends of the members. Circular collars are removably attached to the rod inside of the two mounting members to secure hingeable rear mounting brackets from the water unit against the two mounting members.

Two L-shaped brackets attach at one end to opposite sides of the printing press just below the mounting members and extend in an inverted manner rearwardly from the the mounting members to where their other ends connect with and support the inking unit of the printing press.

DETAILED DESCRIPTION OF THE PREFERRED EMBODIMENT

Figure 1:
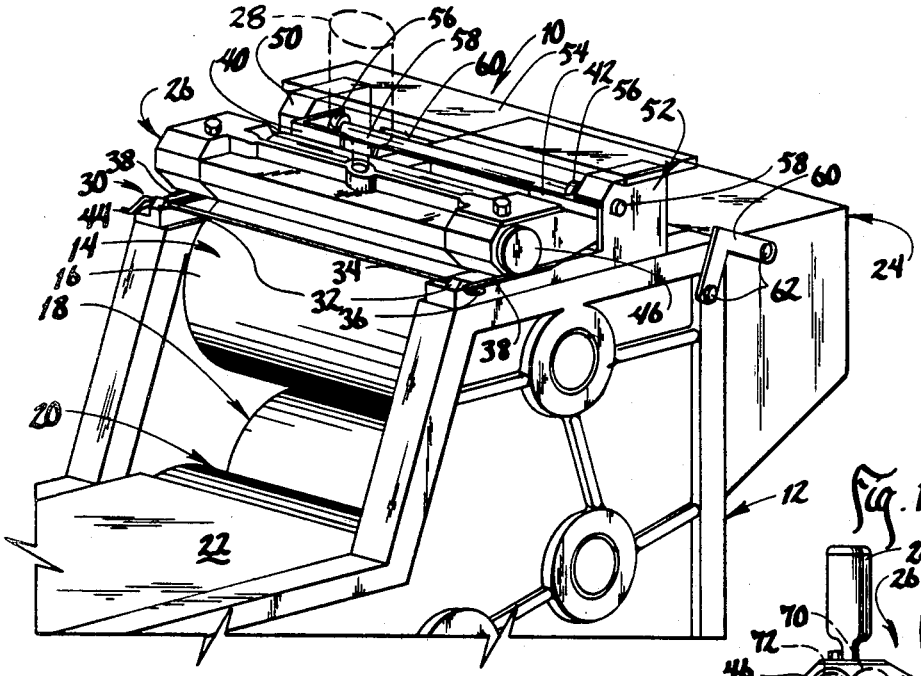
FIG. 1 is a perspective side view of the invention as operatively attached to a printing press and a water unit.

In reference to the drawings, and particularly FIG. 1, there is shown a mounting means 10 for attachment of a water unit 26 and an inking unit 24 to a printing press 12, in accordance with the invention. Mounting means 10 comprises left and right mounting members 50 and 52, connecting rod 58 with associated securing collars 56, shield member 54 and L-shaped inking unit brackets 60.

The major components of printing press 12, which are not a part of the invention, are as follows: Blank stock is fed into the printing roller assembly which includes cylinders 14, 18 and 20. A printed image is contained on a plate 16 which is circumferentially placed on plate cylinder 14. Inking unit 24 supplies ink to the plate while water unit 26 washes ink away from the non-image areas of plate 16. The inked image is then transferred to blanket cylinder 18. Blank stock passes between blanket cylinder 18 and impression cylinder 20 and receives the printed image before passing to output mechanism 22.

Water unit 26 extends from opposite sides of printing press 12 across plate cylinder 14 so that it may come in contact with plate 16. Water unit 26 is adjustable so that it may be selectively raised away from plate 16. This is accomplished by means of lifting mechanism 30 and hingeable brackets 40 and 42, which are also not part of the invention. Hingeable brackets 40 and 42 are secured to the back of water unit 26 and extend to connecting rod 60. They are held against mounting members 50 and 52 by collars 56 but are allowed circumferential movement. Lifting mechanism 30 includes water unit runners 38 which extend out to an eccentric shaft 36 connected to a handle 44 at the front end of mounting member 50. Triangular securing pieces 32 secure the cross-shaft 34 of eccentric rod 36 and are attached to mounting members 50, 52 by threaded fasteners which are received into threaded apertures 76. Adjustment knobs 38 are located externally of water unit 26 and allow the operator to adjust the output of solution which is supplied by solution bottle 28.

Figure 2:
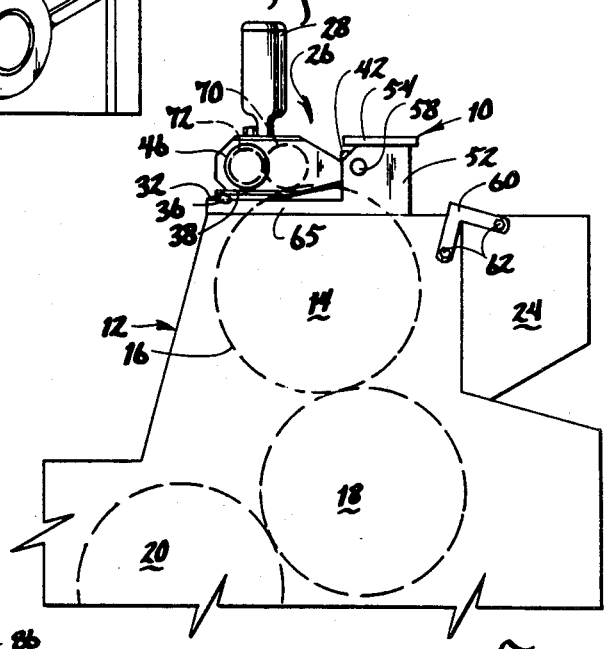
FIG. 2 is a side view of FIG. 1.

With further reference to FIG. 2, the functional association of water unit 26 to printing press 12 can be seen. Plate form roller 70 of water unit 26 directly contacts plate cylinder roller 14. Solution from solution bottle 28 flows down into the nip between plate form roller 70 and a metering roll 72. The solution is then carried by plate form roller 70 onto plate 16 and serves to wash the ink from the non-image areas. Left and right mounting members 50 and 52 have front ends 64 and 65 and back ends 67 and 68 respectively. Water unit 26 is mounted upon front ends 64 and 65. Back ends 67 and 68 support a shield member 54 which is utilized to protect the operator from moving parts of printing press 12, and particularly the inking unit 24. L-shaped inking unit brackets 60 are fastened to opposite sides of printing press 12 by bolts 62 and extend rearward to support the upper portions of inking unit 24.

Figure 4:
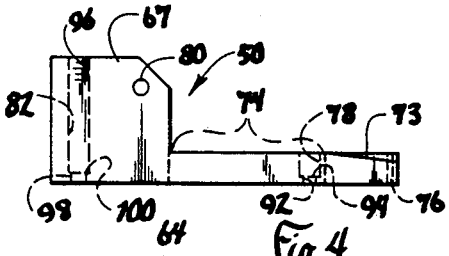
FIG. 4 is a side view of mounting member 32.
Figure 3:
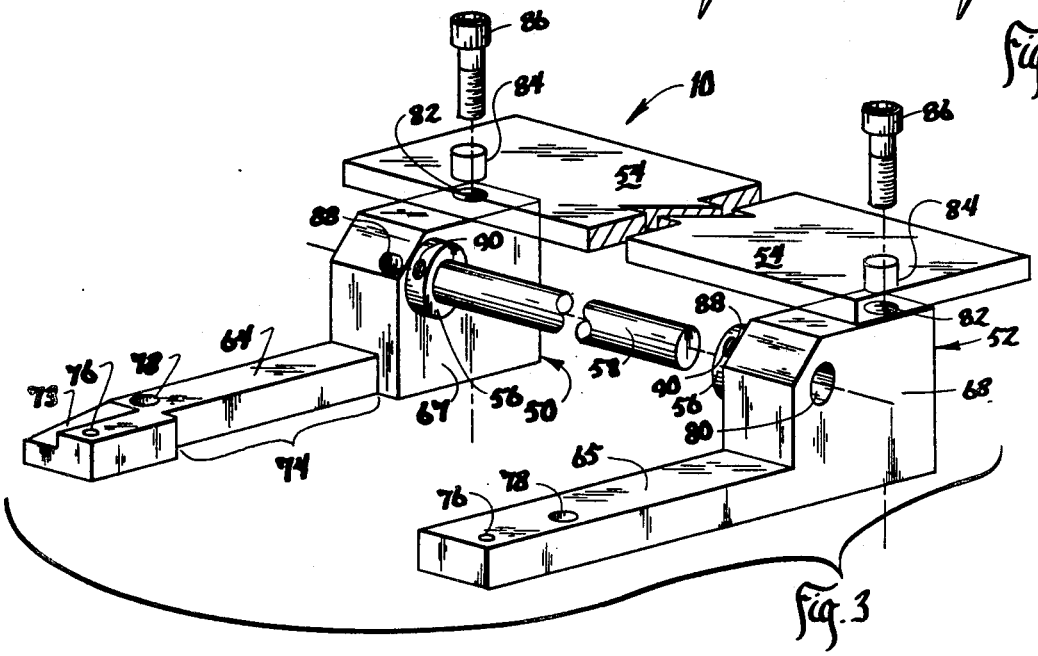
FIG. 3 is an exploded view of the invention.

FIGS. 3 and 4 show the exact structure of mounting members 50 and 52. Front ends 64 and 65 are of narrow elongated configuration with generally flat upper surfaces. Back ends 67 and 68 are raised in comparison with front ends 64 and 65, and present flat top surfaces for the placement of shield 54.

Left mounting member 50, shown specifically in FIG. 4, differs from right mounting member 52 in that an indented slot 74 exists along the inner side of front end 64. Slot 74 allows for the passage of a revolving appendage of the gear drive for plate cylinder 14. Additionally, beveled front end portion 73 allows for the operation of lifting mechanism handle 44.

Mounting means 10 is utilized as follows. Left and right mounting members 50 and 52 are fastened to printing press 12 by means of cap screws 86 which are dropped through bores 82 of backing 67 and 68 and bores 78 of front ends 64 and 65. The heads of cap screws 86 are supported by shoulders 100 and 94 of bores 82 and 78, shoulders 100 being formed by having similar bores 92 and 98 at the bottom of larger bores 78 and 82.

Water unit 26 is then mounted in place by first fastening triangular pieces 32 by cap screws into threaded apertures 76 and then securing hinge brackets 40 and 42 against the inside surfaces of back ends 67 and 68 by means of passing connecting rod 60 through apertures 80 and pressing and tightening down collars 56 by means of set screws 88.

L-shaped inking unit brackets 60 are fastened to printing press 12 and inking unit 24, respectively, by bolts 62. Finally, shield 54 is positioned upon back ends 67 and 68 by threaded fasteners which extend through apertures 84 and threadably mate with threads 96 in bores 82. Alternatively, plugs could be extended through apertures 84 to hold the shield 54 in place.

The above described invention is the preferred embodiment, however, it is to be understood that changes can be made in the preferred embodiment herein and stay within the boundaries of the invention.

What is claimed is:

1. A mounting bracket for a dampening system water unit, which replaces a conventional water unit which usually includes one or more molletons, which allows said dampening system water unit to be mounted on a wider range of offset printing presses, said presses having a revolving plate cylinder and inking unit, said bracket comprising:

(a) left and right mounting members of elongated shape mounted adjacent opposite ends of said revolving plate cylinder of said offset printing presses, each said mounting member having a front end and a back end, each said front end having a top water unit mounting surface, each said back end extending vertically higher than said front end and having a top shield mounting surface and side walls;

(b) connecting means disposed between said mounting members for hingeable reception of said water unit; and (c) L-shaped inking unit brackets connected at one end to opposite sides of said printing press and at the other end to opposite sides of an inking unit to assist in supporting said inking unit in a position adjacent to said back ends of said mounting members.

2. The device of claim 1 wherein said left mounting member has an indentation along the inner side of said water unit mounting surface to avoid conflict with a rotating appendage of said revolving plate cylinder.

3. The device of claim 1 wherein said left mounting member has a beveled portion on said water unit mounting surface sloping downward from said top water unit mounting surface forwardly to the front of said left mounting member.

4. The device of claim 1 wherein said front ends of said left and right mounting members have apertures for reception of securing means to said printing press and securing means from said water unit.

5. The device of claim 1 wherein said connecting means comprises an elongated rod which extends through horizontal apertures in said vertical sides of said back ends of said mounting members and is secured by circular collars which are removably attached to said rod.

6. The device of claim 1 wherein a shield member is mounted to said shield mounting surfaces of said back ends of said mounting members and extends generally horizontally rearward of said back ends of said mounting members.

7. The device of claim 1 wherein said inking unit brackets have apertures at both ends for reception of securing means to said inking unit and said printing press.

8. The device of claim 6 wherein said shield member is a transparent plate having apertures for reception of securing means to said shield mounting surfaces.

9. The device of claim 6 wherein said shield member is a transparent plate having downward extending plug members for securing insertion into said shield mounting surfaces.

10. A mounting means for a dampening system for an offset printing press water unit having a revolving plate cylinder and inking unit said mounting means comprising:

(a) left and right mounting members of elongated shape mounted longitudinally across the revolving plate cylinder on opposite sides of an offset printing press, each having a front end and a back end, each said front end having a top water unit mounting surface, each said back end extending vertically higher than said front end and having a top shield mounting surface, said left mounting member having an indentation along the inner side of said water unit mounting surface to avoid conflict with any rotating appendage of said revolving plate cylinder, and having a beveled front tip portion to avoid conflict with any vertically adjustable appendage of said water unit;

(b) connecting means disposing between mounting members for hingeable reception of said water unit so that said water unit can be adjustably positioned into operable engagement with said revolving plate cylinder or removed from said operable engagement.

11. A mounting bracket for the operable attachment of an automatic dampening system water unit replacement for a conventional water unit to a printing press which has a revolving plate cylinder, said automatic dampening system maintaining the ink-water balance on said plate and having a plate form roller which directly contacts said plate and carries a special fountain solution to said plate which is regulated by a metering roller which is in contact with said plate form roller, comprising:

(a) left and right mounting members of elongated shape mounted on opposite sides of the revolving plate cylinder of the offset printing press and each having a front end and a back end, each said front end having a top water unit mounting surface, each said back end extending vertically higher than said front end and having a top shield mounting surface;

(b) connecting means disposed between said mounting members for stabilization and support of said mounting members and for reception of hinged attachment means connected to said water unit so that said water unit can be hingedly adjusted into operable engagement with said revolving plate cylinder or removed from said operable engagement.

12. The device of claim 11 wherein L-shaped inking unit brackets are connected at one end to opposite sides of said printing press and at the other end to an inking unit to assist in supporting said inking unit in a position adjacent to said back ends of said mounting members.

13. The device of claim 11 wherein a shield is secured to said top shield mounting surface.

14. The device of claim 11 wherein said connecting means comprises an elongated rod extending between said left and right mounting members.

15. The device of claim 14 wherein said automatic dampening system is hingeably secured to said elongated rod so that it can be adjusted between an operable plate contacting position and a nonoperating position.

16. The device of claim 14 wherein said elongated rod is secured between said mounting members by inserting opposite ends of said rod into apertures in said mounting members and having collar means on said rod interiorly of said mounting members and being adjustably fixable along said rod by securing means.

17. The device of claim 16 wherein said securing means for said collar means comprises set screws.

* * * * *